US005282984A

United States Patent [19]

Ashrawi

[11] Patent Number: 5,282,984

[45] Date of Patent: Feb. 1, 1994

[54] GENERATING BITUMEN-IN-WATER DISPERSIONS AND EMULSIONS

[75] Inventor: Samir S. Ashrawi, Austin, Tex.

[73] Assignee: Texaco Inc., White Plains, N.Y.

[21] Appl. No.: 827,299

[22] Filed: Jan. 30, 1992

Related U.S. Application Data

[63] Continuation-in-part of Ser. No. 543,001, Jun. 25, 1990, abandoned.

[51] Int. Cl.[5] ..... C10G 1/04

[52] U.S. Cl. ..... 252/8.554; 208/390; 166/272; 166/275

[58] Field of Search ..... 252/311.5, 8.554; 166/272, 275; 208/390

[56] References Cited

U.S. PATENT DOCUMENTS

| | | | |
|---|---|---|---|
| 2,288,857 | 7/1942 | Subkow | 166/275 X |
| 3,802,508 | 4/1974 | Kelly et al. | 166/272 |
| 3,977,471 | 8/1976 | Gale et al. | 166/275 X |
| 4,077,471 | 3/1978 | Shupe et al. | 166/272 X |
| 4,085,799 | 4/1978 | Bousaid | 166/272 |
| 4,088,189 | 5/1978 | Shupe | 166/275 X |
| 4,121,661 | 10/1978 | Redford | 166/272 X |
| 4,175,618 | 11/1979 | Wu et al. | 166/272 X |
| 4,189,184 | 2/1980 | Green | 166/272 X |
| 4,231,427 | 11/1980 | Kalfoglou | 166/275 |
| 4,293,428 | 10/1981 | Gale et al. | 166/275 X |
| 4,318,816 | 3/1982 | Schievelbein | 166/275 X |
| 4,458,759 | 7/1984 | Isaacs et al. | 166/272 |
| 4,460,481 | 7/1984 | Schievelbein | 166/275 X |
| 4,475,592 | 10/1984 | Pachovsky | 166/272 |
| 4,535,845 | 8/1985 | Brown et al. | 166/272 |
| 4,612,989 | 9/1986 | Rakach et al. | 166/272 X |
| 4,733,728 | 3/1988 | Morita et al. | 166/275 X |
| 4,743,385 | 5/1988 | Angstadt et al. | 166/272 X |
| 4,846,275 | 7/1989 | McKay | 166/272 |
| 4,919,206 | 4/1990 | Freeman | 166/272 X |
| 4,979,564 | 12/1990 | Kalpakci et al. | 166/275 X |

*Primary Examiner*—Gary Geist

*Attorney, Agent, or Firm*—James L. Bailey; Harold J. Delhommer

[57] ABSTRACT

The invention is a method for generating bitumen-in-water dispersions and emulsions useful for recovering and transporting bitumen, which comprises mixing an aqueous surfactant solution with bitumen at an elevated temperature, said surfactant system comprising about 0.005% to about 5% by weight of a sulfonate surfactant represented by the formula

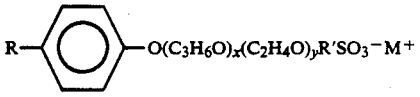

wherein R is an alkyl chain of about 6 to about 16 carbon atoms, x has an average value of about 2 to about 10, y has an average value of about 1 to about 10, R' is ethylene, propylene or butylene, and $M^+$ is an alkali metal or ammonium ion.

12 Claims, No Drawings

GENERATING BITUMEN-IN-WATER DISPERSIONS AND EMULSIONS

BACKGROUND OF THE INVENTION

This is a continuation-in-part of U.S. Pat. application Ser. No. 07/543,001, filed Jun. 25, 1990, now abandoned.

This invention relates to a method for generating bitumen-in-water dispersions and emulsions by use of an aqueous surfactant solution. More particularly, the invention may be employed as a method to recover bitumen from an underground formation, remove bitumen from mined tar sands, and to transport bitumen through pipelines.

Due to the existence of enormous hydrocarbon reserves in the form of tar sands in Canada and elsewhere, the recovery of bitumen from tar sands is a subject which has prompted much research and development. Unlike more well-known forms of underground hydrocarbons, bitumen is difficult to produce. Tar sand bitumen does not flow out of the ground in primary production. Standard enhanced oil recovery techniques simply do not work. Generally, tar sands must be mined and extracted from rock on the surface. Some methods exist for heating a tar sand formation underground and recovering some bitumen.

Contrary to popular belief, tar sand bitumens are not the equivalent of "heavy oils." They are sedimentary rocks with natural porosity, whose pore volume is occupied by viscous, petroleum-like hydrocarbons. In addition to compositional differences, they are considerably more viscous than heavy oils. Consequently, these oil-bearing stones generally have to be mined and specially processed to recover the contained bitumen.

Bitumen has been defined as a mixture of hydrocarbons soluble in carbon disulfide and comprised of solid to viscous, semi-solid liquids. See *The Condensed Chemical Dictionary,* revised by Gessner Hawley, Van Nostrand Reinhold Company, New York (10th ed. 1980).

In addition to its substantially higher viscosity, tar sand bitumen differs from heavy oils in other aspects. The bitumen particles are substantially larger. The chemistry of the bitumen itself is different. Tar sand bitumen contains greater amounts of asphaltees and polar compounds compared to heavy oils. Although the word "bitumen" may have several meanings, when used herein, bitumen refers to the viscous hydrocarbons entrapped within tar sands.

Considerable research and pilot studies on surfactant flooding of underground petroleum is reflected in the literature. Large numbers of sulfonate and sulfate surfactants have been disclosed as being useful for enhanced oil recovery purposes but not necessarily disclosed as useful for tar sand bitumen.

U.S. Pat. No. 2,978,409 discloses a surfactant for the elimination of water block in the near wellbore area of oil wells. The surfactant has the structure

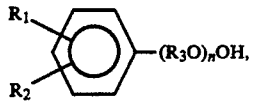

where $R_1$ and $R_2$ each equal H or an alkyl group with 1 to 20 carbon atoms, n equals 4–19, and $R_3$ equals ethylene, propylene or butylene. The disclosure states that the alkylene oxide may be mixed alkylene oxide with some ethylene oxide, or all ethylene oxide, or blocked addition of alkylene oxide, such as propylene oxide/ethylene oxide, butylene oxide/ethylene oxide or ethylene oxide/propylene oxide.

U.S. Pat. Nos. 3,246,023 and 3,268,563 disclose a general detergent, demulsifying and emulsifying surfactant for different purposes including enhanced oil recovery wherein the surfactant is an ester having a structure of $R(AO)_n$, wherein the alkylene oxide (AO) may be a blocked propylene oxide/ethylene oxide or other combinations.

A low foaming surfactant for use in dishwashing machines is disclosed in U.S. Pat. No. 3,499,841 having the structure $$\text{(glycol monomer)}_{5-12}\text{—}CH_2O(C_3H_6O)_n(C_2H_4O)_m$$

U.S. Pat. No. 4,043,922 discloses a solubilizing agent for an enhanced oil recovery surfactant system wherein the solubilizer has the structure

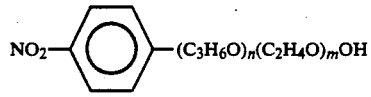

wherein n equals 1–10 and m equals 5–40.

Detergents are disclosed in U.S. Pat. Nos. 2,979,528 and 3,101,374 having the structure $$R(C_3H_6O)_n(C_2H_4O)_m$$

where R is an amine or polyamine having 6 or less carbon atoms. U.S. Pat. No. 2,677,700 discloses a general detergent with a high salinity tolerance having the structure $$R(C_3H_6O)_n(C_2H_4O)_mH$$

where R has 1, 3 or 4 carbon atoms. U.S. Pat. No. 3,036,130 discloses a general detergent having the structure $$R(C_2H_4O)_m(C_3H_6O)_nH$$

where is lower molecular weight reactive hydrogen compound.

Another alkylaryl surfactant having a blocked alkylene oxide chain is disclosed in Chemical Abstracts 88:138812q abstracting from Babalyan, G. A. et al., T. R. Bashk. Gos. Nauchno-Issled. Proektn. Inst. Neft. Prom-sti., 1976, Vol. 46, pp. 10–13. A portion of the article discusses an East German dishwashing and textile detergent known as Prevocell W-OFP, an ethoxylated propoxylated fatty alcohol having the structure

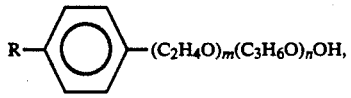

where R is an higher aliphatic alcohol.

Additional alkoxylated alkylaryl surfactants are disclosed in U.S. Pat. Nos. 4,088,189; 4,293,428; 4,540,049;

4,540,050 and 4,577,688, all for enhanced oil recovery uses. U.S. Pat. No. 4,088,189 discloses an enhanced oil recovery surfactant having the structure $$RO(R'O)_nR''SO_3^-M^+,$$

where R is an alkyl or alkylaryl radical having 8 to 24 carbon atoms, R' is ethyl or an ethyl/propyl mixture, R'' is an alkyl chain having 2, 3 or 4 carbon atoms, n=1-20, and $M^+$ is a monovalent cation.

U.S. Pat. No. 4,293,428 discloses an enhanced oil recovery surfactant having the structure $$R_1O(C_3H_6O)_n(C_2H_4O)_mYX$$

where $R_1$ is an alkyl or alkenyl substituted benzene radical with a nonaromatic portion having 6 to 24 carbon atoms, m=1-10, N=1-10, Y is a hydrophilic group, and X is a monovalent cation.

U.S. Pat. Nos. 4,540,049; 4,540,050; and 4,577,688 disclose an enhanced oil recovery surfactant designed to produce a blocking foam when coinjected with steam having the structure $$RO(R'O)_nR''SO_3^-M^+$$

wherein R is an alkyl radical, branched or linear, or an alkyl benzene, alkyl toluene or alkyl xylene group having from about 8 to about 24 carbon atoms in the alkyl chain, R' is ethyl, propyl or a mixture of ethyl and propyl, n=1-20, R'' is ethyl, propyl, hydroxypropyl or butyl, and $M^+$ is alkali metal or ammonium ion.

U.S. Pat. Nos. 4,705,110 and 4,722,396 disclose a carboxymethylated oxethylate surfactant for enhanced oil recovery purposes having the structure $$RO(C_3H_6O)_n(C_2H_4O)_mCH_2COOM.$$

Transportation of heavy crudes is discussed in general in Taylor, A. S. et al., "Viscous Crude Oil Transportation: The Preparation Of Bitumen, Heavy And Ext. Heavy Crude Oil/Water Emulsions," Third International Conference on Heavy Oil and Tar Sands, July 1985; and Canadian Pat. No. 1,137,005. A general discussion on emulsification of crude oils can be found in Thompson, D. G. et al., "Emusification And Demulsification Related To Crude Oil Production," *The Formation Of Liquid/Liquid Dispersions Chemical And Engineering Aspects.*

SUMMARY OF THE INVENTION

The invention is a method for generating bitumen-in-water dispersions and emulsions, which comprises mixing an aqueous surfactant solution with bitumen at an elevated temperature. The surfactant system comprises about 0.005% to about 5% by weight of a sulfonate surfactant represented by the formula

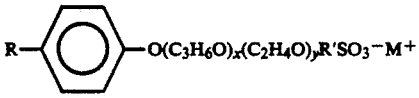

wherein R is an alkyl chain of about 6 to about 16 carbon atoms, x has an average value of about 2 to about 10, y has an average value of about 1 to about 10, R' is ethylene, propylene or butylene, and $M^+$ is an alkali metal or ammonium ion.

Bitumen may be recovered from an underground formation by injecting the same aqueous surfactant solution into an underground formation and producing a dispersion or emulsion of bitumen in the surfactant solution from a production well. The invention is also useful as a method for transporting bitumen in pipelines by forming a dispersion or emulsion with the surfactant system and bitumen, and pumping the dispersion or emulsion through a pipeline.

DETAILED DESCRIPTION

It has been discovered that certain propoxylated, ethoxylated sulfonate surfactants can be used at low concentrations to generate stable bitumen-in-water emulsions. Because these emulsions are water-based, they have viscosities that are close to that of water and significantly lower than that of tar sand bitumen. The produced emulsions also appear to be stable to flow through sandpacks, offering a system for in situ recovery of bitumen from tar sand deposits, preferably where communication channels exist.

The ability to use these alkoxylated sulfonate surfactants as bitumen emulsifiers at elevated temperatures provides a solution to several vexing problems in working with tar sand bitumen. First, a surfactant solution containing the instant surfactants, alone or with other surfactants and solubilizers, may be injected into tar sand deposits to emulsify bitumen in situ and transport it to producing wells. Second, bitumen may be recovered in surface facilities from mined tar sands by emulsification to separate the bitumen from undesired material. Third, bitumen may be transported in the form of a water-base emulsion through pipelines.

The invention is a method for generating bitumen-in-water dispersions and emulsions, which comprises mixing an aqueous surfactant solution with bitumen at an elevated temperature, wherein the surfactant solution comprises about 0.005% to about 5%, preferably about 0.01% to about 1.0% by weight of a sulfonate surfactant represented by the formula

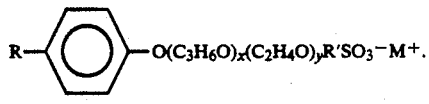

In the surfactant, R is an alkyl chain of about 6 to about 16 carbon atoms, x has an average value of about 2 to about 10, y has an average value of about 1 to about 10, R' is ethylene, propylene or butylene, and $M^+$ is an alkali metal or ammonium ion.

In the preferred surfactants, x has an average value of about 3 to about 7, y has an average value of about 2 to about 5, and R has about 7 to about 10 carbon atoms. The preferred alkali metal ions are sodium, lithium and potassium. It should be noted that x and y are average values and that the surfactant compounds used in the invention method will normally have varying degrees of propoxylation and ethoxylation. These alkoxylated sulfonate surfactants may be produced by adding different amounts of propylene oxide, followed by ethylene oxide to alkylphenols, then capping the product with an alkyl sulfonate moiety.

Depending on circumstances and the physical and chemical characteristics of the bitumen and surfactant solution employed, the bitumen and surfactant solution will form either an emulsion or a dispersion within the aqueous solution. Although an emulsion is preferred because of additional stability, dispersions produced according to the invention may be stable enough for some purposes.

Because of the highly viscous, immobile nature of tar sand bitumen, it is generally necessary to heat the bitumen to an elevated temperature in order to do anything with it. The invention method contemplates operation at an elevated temperature, preferably a temperature greater than about 60° C., most preferably greater than about 100° C. The instant surfactants involved in the invention method are stable at the high temperatures encountered in steamfloods of about 150° to 300° C.

One method of practically employing the emulsion forming method of the present invention is to recover bitumen from an underground formation with in situ emulsification. An aqueous surfactant solution is injected into an underground formation penetrated by at least one injection well and at least one production well, producing a dispersion or emulsion of bitumen in the surfactant solution from the underground formation via a production well. After being produced through a production well, the bitumen emulsions are treated by established emulsion breaking methods at the production site, or are transported by pipeline to a nearby treating facility.

If the bitumen formation has been previously heated to an elevated temperature or if the surfactant solution system is at an elevated temperature, or if a thermal fluid is coinjected with the surfactant solution, a bitumen-in-water emulsion or dispersion will form. Continuing injection of the surfactant solution or the use of a drive fluid which may be thermal in nature will drive the emulsion dispersion through channels or fractures towards a producing well and eventual production to the surface.

Elevated temperature may be provided to the formation by one or more of several methods. The bitumen may be heated in situ by the injection of a thermal fluid such as hot water or steam prior to the injection of the surfactant solution. The surfactant solution itself may be heated. A thermal fluid such as hot water or steam may also be coinjected with the surfactant solution. An additional method is to initially inject a thermal fluid, followed by the surfactant solution, and then repeat the injection of thermal fluid and surfactant solution after surfactant solution injection.

Mined tar sands may be mixed with the dilute surfactant solution according to the invention, preferably about 0.01% to about 1% and agitated. The bitumen is stripped off the mined sand and forms an emulsion with the surfactant solution. The sands are then settled and the emulsion is transported for breaking by established methods known in the art.

The emulsion and dispersion forming invention may also be employed for transporting bitumen in pipelines. This invention method comprises mixing the instant aqueous surfactant solution with bitumen at an elevated temperature to form a dispersion or emulsion, and pumping the dispersion or emulsion through a pipeline.

The alkoxylated sulfonates employed in the invention offer a great deal of structural flexibility. The length of the alkyl group attached to the aromatic ring, as well as the amounts of propylene oxide and ethylene oxide can be varied to achieve a desired hydrophilic/lipophilic balance of the surfactant. Such tailoring of the surfactant to the individual bitumen being emulsified yields increased performance with bitumens of varying chemical and physical characteristics.

Water solubility of the surfactant may be decreased by decreasing the number of ethylene oxide groups. By the same token, increasing the number of ethylene oxide groups, decreasing the number of propylene oxide groups, and decreasing the length of the alkyl chain on the aromatic ring are all steps which will increase water solubility and decrease oil solubility. Conversely, increasing the number of propylene oxide groups and the length of the alkyl chain will render the compound more lipophilic and less hydrophilic.

The following examples will further illustrate the present invention which discloses a method for generating bitumen-in-water dispersions and emulsions. These examples are given by way of illustration and not as limitations on the scope of the invention. Thus, it should be understood that procedures and amounts may be varied with the process still remaining within the scope of the invention.

EXAMPLES

Emulsion stability was measured in bottle tests by adding surfactant solution to bitumen to produce a system with nominal 15% (Table 1) and 25% (Table 2) bitumen content at different salt concentrations and pH conditions. The bitumen employed was obtained from a Syncrude facility in Alberta, Canada. It had a gravity of 7.8° API. SARA analysis according to U.S. Pat. No. 4,865,741 indicated 23.16% saturates, 44.52% aromatics, 11.94% resins, and 20.38% asphaltenes. This bitumen behaved as a Newtonian fluid up to a shear rate of 100 $sec^{-1}$. Measured viscosities of this bitumen were: 1004 cp @ 80° C., 749 cp @ 85° C., 542 cp @ 90° C., and 412 cp @95° C.

The alkoxylated sulfonate surfactants employed in the Examples are identified by the nomenclature NP-6PO-40PS, NP-6PO-30PS, NP-6PO-20PS, and NP-3PO-30PS. In this nomenclature, the "NP" stands for nonylphenol, an alkylaryl compound having 9 carbon atoms in the alkyl chain. The "6PO" and "3PO" stand for blocks of 6 and 3 propylene oxide groups, respectively, added to the nonylphenol at the hydroxyl position. The "40PS", "30PS", and "20PS" represent blocks of 4, 3 and 2 ethylene oxide groups, respectively, followed by a propane sulfonate moiety.

The systems were heated for at least an hour in a 90° C. oven and then emulsified with the help of a controlled homogenizer. After mixing, the emulsions were allowed to equilibrate in the 90° oven for an hour. A sample from each was analyzed for water content by a coulometric Karl Fischer titration. Table 1 reports the bitumen content of the emulsions after 1 hour of equilibration when the initial bitumen content was 15%. Table 2 reports the same information when the initial bitumen content of the emulsions was 25%.

Table 1 indicates that in some of the systems, 90 to 100% of the bitumen was still contained within the bitumen-in-water emulsion after 1 hour. Even when the initial bitumen content was raised to 25%, Table 2 indicates that up to 92% (23% of original 25%) of the bitumen remained within the emulsion even at the very low surfactant concentration of 100 ppm (0.01%).

TABLE 1

BITUMEN CONTENT (%) OF EMULSIONS AFTER ONE HOUR EQUILIBRATION (Initial bitumen content = 15%)

| | Salinity, ppm NaCl | | | | | |
|---|---|---|---|---|---|---|
| | Unadjusted pH | | | pH = 10 | | |
| Surf. Conc. | 0 | 500 | 10,000 | 0 | 500 | 10,000 |
| 1000 ppm | | | | | | |
| NP-6PO-40PS | 14.6 | 12.9 | 12.0 | 11.7 | 11.1 | 11.9 |
| NP-6PO-30PS | 15.0 | 15.0 | 11.4 | 13.3 | 13.3 | 12.3 |
| NP-6PO-20PS | 13.4 | 12.9 | 15.0 | 11.8 | 14.6 | 12.9 |
| NP-3PO-30PS | 13.1 | 11.1 | 12.7 | 13.1 | 12.8 | 11.1 |
| 500 ppm | | | | | | |
| NP-6PO-40PS | 14.2 | 12.4 | 9.9 | 10.1 | 8.3 | 12.5 |
| NP-6PO-30PS | 11.1 | 8.9 | 11.4 | 12.8 | 11.9 | 14.4 |
| NP-6PO-20PS | 11.7 | 13.7 | 13.3 | — | 14.6 | 12.9 |
| NP-3PO-30PS | 8.9 | 13.0 | 13.7 | 8.6 | 14.9 | 11.7 |
| 100 ppm | | | | | | |
| NP-6PO-40PS | — | — | — | 13.7 | 11.5 | 6.6 |
| NP-6PO-30PS | — | — | — | 8.9 | 10.0 | 6.6 |
| NP-6PO-20PS | — | — | — | 13.2 | 8.6 | 10.8 |
| NP-3PO-30PS | — | — | — | 9.3 | 6.5 | 7.7 |
| 50 ppm | | | | | | |
| NP-6PO-40PS | — | — | — | 8.9 | 6.9 | 6.0 |
| NP-6PO-30PS | — | — | — | 11.5 | 10.9 | 7.1 |
| NP-6PO-20PS | — | — | — | 13.7 | 10.5 | 12.7 |
| NP-3PO-30PS | — | — | — | 12.0 | 11.5 | 13.1 |

TABLE 2

BITUMEN CONTENT (%) OF EMULSIONS AFTER ONE HOUR EQUILIBRATION AT 500 ppm NaCl AND pH 10 (Initial bitumen content = 25%)

| | SURFACTANT CONCENTRATION, ppm | |
|---|---|---|
| Surfactant | 100 | 10,000 |
| NP-6PO-40PS | 21.7 | 20.7 |
| NP-6PO-30PS | 23.2 | 22.9 |
| NP-6PO-20PS | 19.9 | 17.9 |
| NP-3PO-30PS | 20.5 | 23.8 |

Several examples were run to indicate the transportability of bitumen emulsions in a porous media. Flow tests were conducted at 90° C. in stainless steel core holders packed with 70–140 mesh Ottawa sand. Each flow test consisted of two parts: flood and circulation. In the flood portion, about 4 to 5 pore Volumes of fresh emulsion were injected into the sandpack until a constant bitumen content was obtained in the effluent, indicating saturation of the sandpack with the bitumen-in-water emulsion. In the circulation portion, the last two or three pore volumes of the effluent from the flood portion were circulated through the sandpack to simulate transportation of the emulsion through a sand formation.

The stainless steel core holder for both portions was placed in a temperature controlled oven. The emulsion was placed in a displacement cylinder within the oven. A constant flow rate pump drove a piston in the displacement cylinder, pushing the emulsion through a heating coil and then through the sandpack at a volumetric flow rate of 10 ml/min. Emulsion temperature was monitored at the inlet with a thermocouple and the temperature recorded. The effluent was always sampled at the outlet.

During the circulation portion of the flow test, the emulsion was heated and stirred in a reservoir with a magnetic stir/hot plate and circulated with a positive displacement pump directly through the heating coil and into the sandpack at approximately the same flow rate as the flood portion of the test. The displacement cylinder was disconnected during this portion. Throughout the test, the pressure drop across the sandpack was measured with a pressure transducer and recorded.

Table 3 illustrates the results of five different runs according to the above described transportability scheme, with one run for each surfactant listed. The pH was 10 and the temperature was 90° C for all five runs of Table 3.

TABLE 3

| Emulsion System | FLOODING | | | | CIRCULATION | | | |
|---|---|---|---|---|---|---|---|---|
| (1000 ppm surf.) | $C_i$ | $C_s$ | $V_s$ | $P_s$ | $T_{0.5}$ | $T_{0.1}$ | $T_f$ | $C_f$ |
| NP-6PO-40PS | 19.2 | 95 | 4 | 30 | 2 | 10 | 11 | 5 |
| NP-6PO-30PS | 17.8 | 90 | 4 | 20 | 3 | 11 | 12 | 5 |
| NP-6PO-20PS | 18.2 | 95 | 4 | 12 | 2 | 11 | 12 | 4 |
| NP-3PO-30PS | 19.0 | 95 | 3 | 13 | 1.5 | 11 | 18.5 | 5 |
| NP-3PO-30PS (100 ppm surf.) | 17.6 | 95 | 4 | 13 | 7 | 15 | 19 | 6 |

DURING THE FLOOD PART $C_i$ = initial bitumen concentration in the emulsion, %

$C_s$ = "steady state" bitumen concentration, % of $C_i$ $V_s$ = volume of emulsion required to reach $C_s$, pore volumes $P_s$ = pressure drop across the sandpack at $C_s$, psig

DURING THE CIRCULATION PART $T_{0.5}$ = time required for the bitumen concentration in the effluent to reach 50% of $C_s$, hrs.

$T_{0.1}$ = time required for the bitumen concentration in the effluent to reach 10% of $C_s$, hrs.

$T_f$ = elapsed time at termination of test, hrs.

$C_f$ = bitumen concentration in the emulsion after $T_f$ hours, %

The first run involved a bitumen emulsion with 1000 ppm of NP-6PO-40PS. The original bitumen concentration was 19.2%, sandpack porosity was 35.8%, permeability was 3.8 darcies, and salinity was 10,000 ppm NaCl.

During the flood, the bitumen content rose to nearly 95% of the original concentration after 4 pore volumes of emulsion injection. The pressure drop across the sandpack rose steadily to 30 psi. Within 2 hours of circulation, the bitumen content had dropped to 50% of the original concentration. It took 10 hours of circulation for the bitumen content to drop below 10% of the original. The test was terminated after 11 hours with the bitumen content at about 5% of original concentration.

The second run involved 1000 ppm of NP-6PO-30PS at a salinity of 500 ppm NaCl. The original bitumen concentration was 17.8%, sandpack porosity was 38%, and permeability was 3.5 darcies.

During the flood, the bitumen content rose to nearly 90% of the original concentration after 4 pore volumes of emulsion injection. The pressure drop across the sandpack rose steadily to 20 psi. Within 3 hours of circulation, the bitumen content had dropped to 50% of the original concentration. It took more than 11 hours of circulation for the bitumen content to drop below 10%. The test was terminated after 22 hours with the bitumen content at about 5% of original.

The fifth run involved 1000 ppm of NP-6PO-20PS at a salinity of 10,000 ppm NaCl. Original bitumen concentration was 18.2%, sandpack porosity was 38.8%, and permeability was 3.9 darcies.

During the flood, the bitumen content rose to nearly 95% of the original after 4 pore volumes of emulsion injection. The pressure drop across the sandpack rose steadily to about 12 psi, a significant improvement over Examples 1 and 2. After 3 hours of circulation, the bitumen content dropped to 50% of the original concentration. It took 11 hours of circulation for the bitumen content to drop below 10% of the original. The test was terminated after 12 hours with bitumen concentration at 4% of the original concentration.

The fourth run took place with 1000 ppm of NP-3PO-30PS at 500 ppm NaCl salinity. Original bitumen concentration was 19%, sandpack porosity was 39.3% and permeability was 3.4 darcies.

During the flood, the bitumen content rose to 95% of the original after 3 pore volumes of emulsion injection. The pressure drop across the sandpack rose steadily to about 13 psi, a significant improvement over Examples 1 and 2. Within 1.5 hours of circulation, the bitumen content had dropped to 50% of the original. It took about 11 hours of circulation for the bitumen concentration to drop below 10% of original. The test was terminated after 18.5 hours with bitumen concentration at about 5% of the original, a significant improvement over Examples 1, 2 and 3.

The fifth run of Table 3 was performed with 100 ppm of NP-3PO-30PS surfactant at a salinity of 500 ppm NaCl. Original bitumen concentration was 17.6%, sandpack porosity was 34.1%, and permeability was 4.1 darcies.

During the flood, the bitumen content rose to nearly 95% of the original concentration after 4 pore volumes of emulsion injection, one pore volume later than the same system with 1000 ppm of the same surfactant in the fourth run. The pressure drop across the sandpack rose steadily to about 13 psi. It took almost 7 hours of circulation for the bitumen content to drop to 50% of the original concentration, a significant improvement over all of the previous runs of Table 3. It took more than 15 hours of circulation for the bitumen concentration to drop below 10% of the original bitumen concentration. The test was terminated after 19 hours with the bitumen content at about 6% of original, a substantial improvement over the previous four runs.

This fifth run offered substantial advantages in the stability of the bitumen emulsion and the transportability of the emulsion through the sandpack. It is significant that these advantages were realized with a surfactant concentration of only 100 ppm, one-tenth the surfactant concentration of the previous four runs noted in Table 3.

The substantial differences between the behavior of heavy oils and bitumen were noted in similar emulsification tests of heavy oils. The different chemical makeup and significantly less viscosity of heavy oils make them difficult to emulsify, and in fact, prevent emulsification according to the present invention.

An attempt was made to emulsify a heavy oil from the Lone Rock reservoir in Alberta, Canada and a 35,000 ppm TDS brine with a variety of surfactants at 90° C., using 1000 ppm active surfactant. In addition to the alkylaryl alkoxylated sulfonates of the present invention, other surfactants tried on the Lone Rock heavy oil were ethoxylated nonionics, petrochemical sulfonate anionics, and alpha-olefin sulfonate anionics. In all tested cases the resulting dispersions broke cleanly within 30 minutes, slightly swelling the oil phase and slightly coloring the water phase. Stable emulsions could not be formed with the Lone Rock heavy oil according to the present invention or with a number of other surfactants.

Many variations of the method of this invention will be apparent to those skilled in the art from the foregoing discussion of examples. Variations can be made without departing from the scope and spirit of the following claims.

What is claimed is:

1. A method for generating bitumen-in-water dispersions and emulsions, which comprises:

mixing an aqueous surfactant solution with a hydrocarbon consisting essentially of bitumen at an elevated temperature, said surfactant solution comprising about 0.005% to about 5% by weight of a sulfonate surfactant represented by the formula

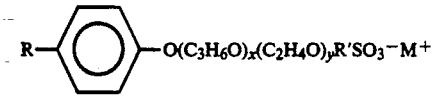

wherein R is an alkyl chain of about 6 to about 16 carbon atoms, x has an average value of about 2 to about 10, y has an average value of about 1 to about 10, R' is ethylene, propylene or butylene, and $M^+$ is an alkali metal or ammonium ion.

2. The method of claim 1, wherein the surfactant solution is mixed with bitumen at a temperature greater than about 60° C.

3. The method of claim 1, wherein x has an average value of about 3 to about 7, y has an average value of about 2 to about 5 and R has about 7 to about 10 carbon atoms.

4. The method of claim 1, wherein the sulfonate surfactant comprises about 0.01% to about 1.0% by weight of the surfactant solution.

5. A method for recovering hydrocarbon consisting essentially of bitumen from an underground formation penetrated by at one injection well and at least one production well, which comprises:

injecting an aqueous surfactant solution into an underground formation via an injection well, said surfactant solution comprising about 0.005% to about 5% by weight of a sulfonate surfactant represented by the formula

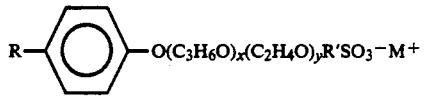

wherein R is an alkyl chain of about 6 to about 16 carbon atoms, x has an average value of about 2 to 10, y has an average value of about 1 to about 10, R' is ethylene, propylene or butylene, and $M^+$ is an alkali metal or ammonium ion; and producing a dispersion or emulsion of bitumen in said surfactant solution from the underground formation via a production well.

6. The method of claim 5, wherein x has an average value of about 3 to about 7, y has an average value of about 2 to about 5 and R has about 7 to about 10 carbon atoms.

7. The method of claim 5, wherein the sulfonate surfactant comprises about 0.01% to about 1.0% by weight of the surfactant solution.

8. The method of claim 5, further comprising injecting the surfactant solution at an elevated temperature greater than about 60° C.

9. The method of claim 5, further comprising injecting a thermal fluid into the formation prior to injecting the surfactant solution.

10. The method of claim 9, wherein the thermal fluid is hot water or steam.

11. The method of claim 9, further comprising repeating the injection of thermal fluid and surfactant solution after surfactant solution is injected.

12. The method of claim 5, further comprising coinjecting steam into the formation with the surfactant solution.

* * * * *